US009915126B2

(12) United States Patent
Andrew et al.

(10) Patent No.: US 9,915,126 B2
(45) Date of Patent: Mar. 13, 2018

(54) HIGH PRESSURE CIRCULATING SHOE TRACK WITH REDUNDANT PRESSURE ISOLATION FEATURE

(71) Applicant: BAKER HUGHES INCORPORATED, Houston, TX (US)

(72) Inventors: Colin P. Andrew, Cypress, TX (US); Douglas J. Lehr, The Woodlands, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 363 days.

(21) Appl. No.: 14/734,790

(22) Filed: Jun. 9, 2015

(65) Prior Publication Data

US 2016/0362961 A1 Dec. 15, 2016

(51) Int. Cl.

| | |
|---|---|
| ***E21B 34/12*** | (2006.01) |
| ***E21B 33/12*** | (2006.01) |
| ***E21B 21/10*** | (2006.01) |
| *E21B 34/00* | (2006.01) |

(52) U.S. Cl.

CPC ..... *E21B 34/12* (2013.01); *E21B 21/10* (2013.01); *E21B 33/12* (2013.01); *E21B 2034/005* (2013.01)

(58) Field of Classification Search

CPC ..... E21B 2034/005; E21B 33/16; E21B 34/12–34/14; E21B 33/05; E21B 34/08; E21B 17/00; E21B 23/06; E21B 21/10

USPC ..... 166/373

See application file for complete search history.

(56) References Cited

U.S. PATENT DOCUMENTS

| | | | | |
|---|---|---|---|---|
| 4,846,281 | A | 7/1989 | Clary et al. | |
| 6,394,187 | B1 | 5/2002 | Dickson et al. | |
| 8,424,611 | B2 | 4/2013 | Smith et al. | |
| 2003/0173091 | A1* | 9/2003 | Horne | E21B 34/08 166/386 |
| 2004/0251032 | A1* | 12/2004 | Luke | E21B 21/08 166/373 |
| 2009/0065195 | A1* | 3/2009 | Chalker | E21B 33/1208 166/183 |
| 2011/0048742 | A1 | 3/2011 | Smith et al. | |
| 2012/0085548 | A1 | 4/2012 | Fleckenstein et al. | |
| 2013/0008652 | A1 | 1/2013 | Broussard et al. | |
| 2013/0092375 | A1* | 4/2013 | Melenyzer | E21B 33/05 166/281 |
| 2014/0238697 | A1 | 8/2014 | Slup et al. | |

* cited by examiner

*Primary Examiner* — George S Gray
(74) *Attorney, Agent, or Firm* — Steve Rosenblatt

(57) ABSTRACT

A dual barrier system withstands pressure differentials well above those of the check valves in a float shoe used to allow circulation of a bottom hole assembly on the way to a desired depth. The bottom hole assembly can have screens and an internal wash pipe that pushes a sleeve to hold open a lower flapper for running in. The wash pipe also holds open an upper flapper that has opposed orientation to facilitate circulation when running in. Once on location an annulus packer closes off the producing zones where the screens are located from a lower zone that can have higher pressures. A high pressure packer is set against the shoe track and the wash pipe is retracted through this packer. Retracting the wash pipe allows closure of both flappers. Flow is blocked in opposed directions by the flappers and packer in the shoe track.

21 Claims, 2 Drawing Sheets

HIGH PRESSURE CIRCULATING SHOE TRACK WITH REDUNDANT PRESSURE ISOLATION FEATURE

FIELD OF THE INVENTION

The field of the invention is completions and more particularly screen assemblies in open hole run in with a shoe track to facilitate placement where a higher pressure interval where the shoe track is located is isolated externally and internally of the completion assembly.

BACKGROUND OF THE INVENTION

In a recent development for completions in open hole into depths where pressures can be 15,000 PSIG or more it has been desirable to facilitate the advancement of the completion to the desired depth with the aid of circulation. In such completions the bottom hole assembly can contain screens from production from a given zone while the borehole may continue further into another zone that can produce higher pressures. To date the available pressure rating of shoe track equipment is only in the realm of about 5,000 PSIG. At the same time regulations have been made stricter regarding dual isolators for the high pressure zones. One of the risks for known float shoes that are used to aid circulation when running in is that the check valves in such a shoe will experience differential pressure from a high pressure formation below the producing formation where the screens are located so as to fail. For that reason the dual check valves in such float shoes cannot be considered under the regulations as effective dual isolation devices. One expensive way in the past to cope with this issue is to essentially cement in place the length of the shoe track in the annular space and internally. Such a procedure is not only expensive but presents concerns of reliability of the seal that is obtained.

Dual flappers are illustrated in U.S. Pat. No. 8,424,611; US 2014/0238697 (FIG. 12) and U.S. Pat. No. 6,394,187.

The present invention seeks to address this problem in a functionally effective and economical way. The producing zone is externally isolated just above the shoe track. The wash pipe that goes through the screen assembly extends through a packer and down to a lower flapper to push a sleeve to hold the lower flapper open. This allows circulation when running in. Once having reached the desired depth with the screens an isolation packer such as a swell packer begins to swell to close off the annulus against the open hole to prevent fluids from further downhole from migrating up to the screens adjacent the producing zone. Within the shoe track, the high pressure rated packer is set against the inside wall. The wash pipe is picked up to allow the lower flapper to close. This flapper is oriented to prevent flow from coming uphole. The lower flapper is disposed below the high pressure isolation packer. Further removal of the wash pipe allows a top flapper to fall to a closed position. This flapper prevents flow from uphole to downhole thus allowing for well control with pressure applied to the flapper from the surface with the flapper on its seat. Thus the low pressure rating of the float shoe and its check valves is removed as a problem because the assembly of the flappers and the high pressure packer provide the needed high pressure barriers. Those skilled in the art will appreciate these and other aspects of the invention from a review of the description of the preferred embodiment and the associated drawings while appreciating that the full scope of the invention is to be determined from the appended claims.

SUMMARY OF THE INVENTION

A dual barrier system is provided to withstand pressure differentials well above those of the check valves in a float shoe used to allow circulation of a bottom hole assembly on the way to a desired depth. The bottom hole assembly can have screens and an internal wash pipe that pushes a sleeve to hold open a lower flapper for running in. The wash pipe also holds open an upper flapper that has opposed orientation to facilitate circulation when running in. Once on location an annulus packer closes off the producing zones where the screens are located from a lower zone that can have higher pressures. A high pressure packer is set against the shoe track and the wash pipe is retracted through this packer. Retracting the wash pipe allows closure of both flappers. Flow is blocked in opposed directions by the flappers and packer in the shoe track.

BRIEF DESCRIPTION OF THE DRAWINGS

FIG. 1 shows circulation of the bottom hole assembly when running in;

DETAILED DESCRIPTION OF THE PREFERRED EMBODIMENT

Figure 1:
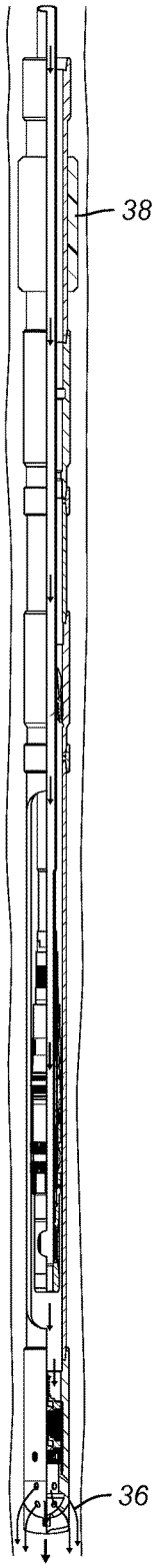
Figure 2:
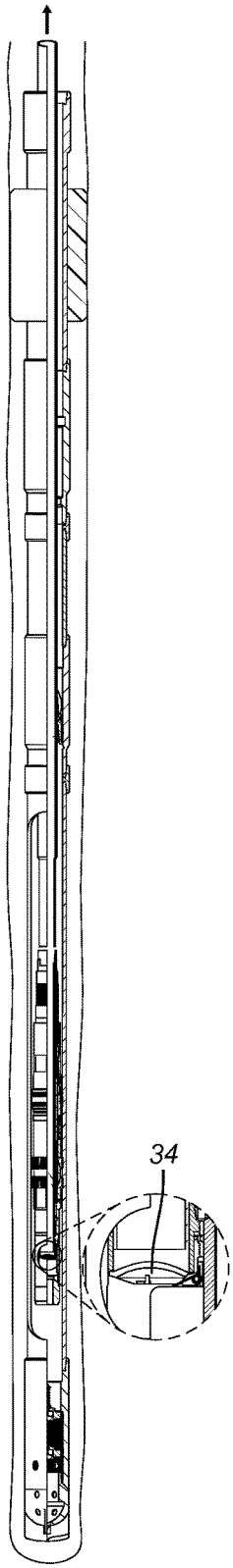
FIG. 2 is the view of FIG. 1 showing the wash pipe lifted to allow the lower flapper to close.
Figure 3:
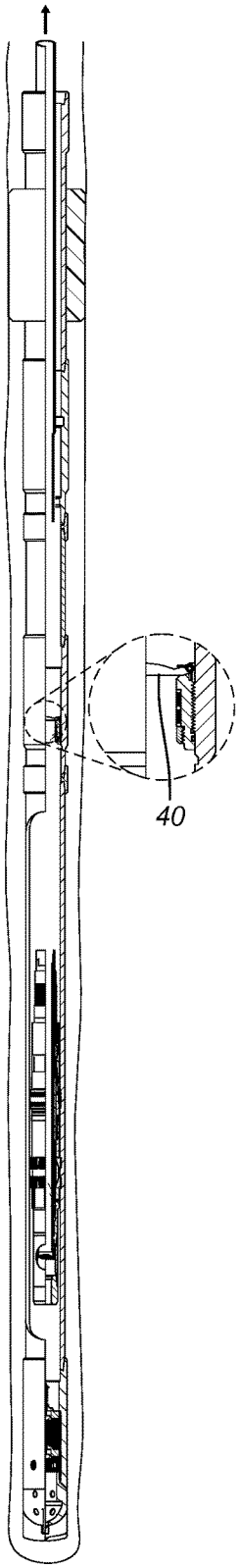
FIG. 3 is the view of FIG. 2 with the wash pipe further lifted to allow the upper flapper to close.
Figure 4:
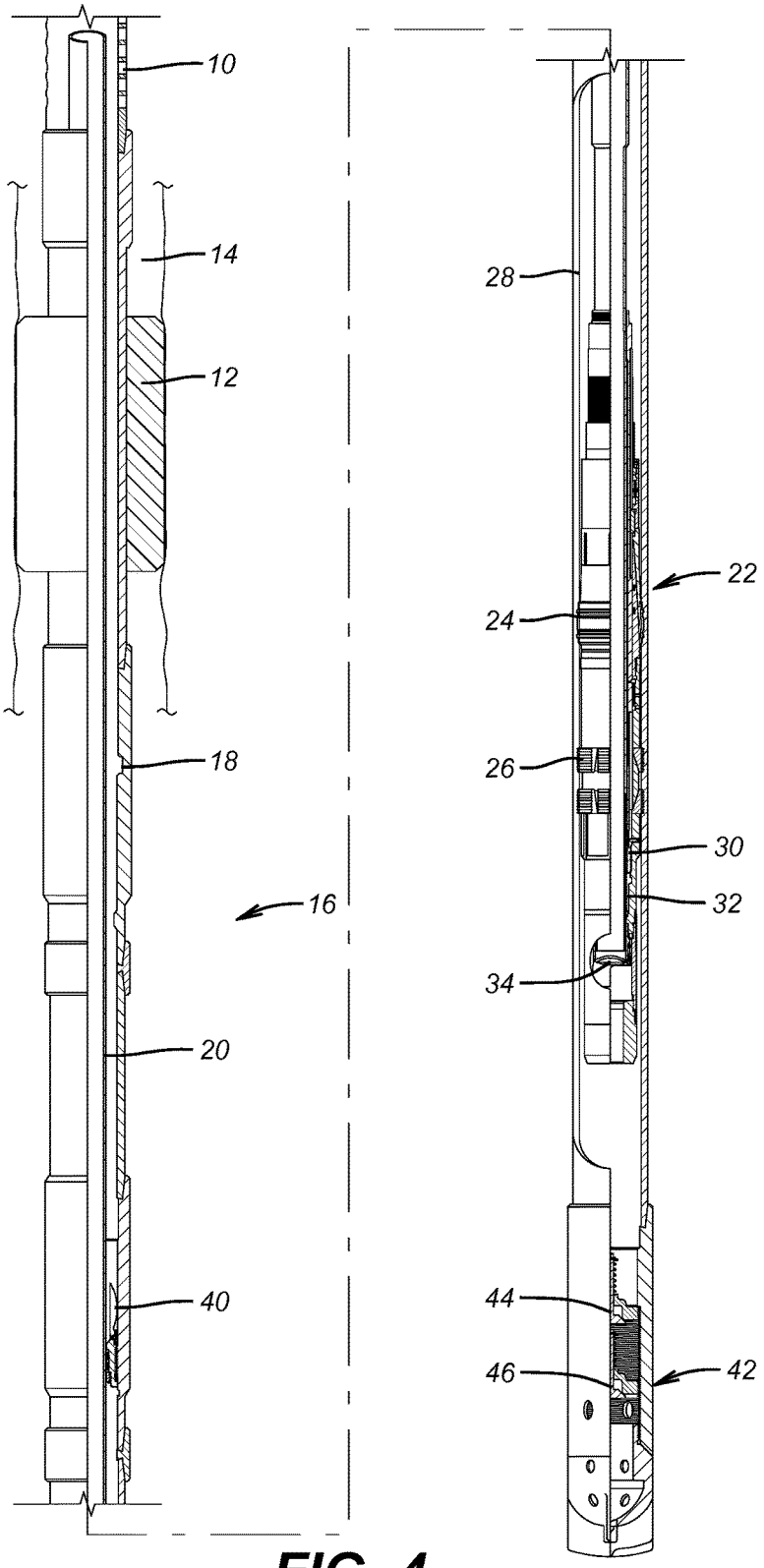
FIG. 4 is an enlarged view of FIG. 2.

Referring to FIG. 4, screens 10 are part of the outer assembly that further includes a swelling packer 12 to close off annulus 14 above. Alternatively, ports can be provided for other types of operations such as injection service. The shoe track 16 has a nipple profile 18 to selectively accept a plug that is not shown, if needed for additional isolation after the inner assembly or wash pipe 20 is removed. Wash pipe 20 removably extends through high pressure rated packer 22 that has a sealing element 24 optionally engaging a polished bore and slips 26 that find support and seal against inner wall 28 parts of which can be polished bores. The wash pipe 20 with the packer 22 are run in with the outer assembly of which the shoe track 16 forms a part. The packer 22 can be set when running in. Circulation when running in is enabled because the wash pipe 20 pushes on a sleeve 30 against a spring bias 32 so as to push flapper to an open position. The orientation of the flapper 34 is such that flow from the surface in circulation will push it open but sleeve 30 when displaced by the wash pipe 20 will hold the flapper 34 open for circulation. It is noted that the flapper 34 is closed in FIG. 2 representing the position it takes when the wash pipe 20 is raised away from sleeve 30 that is then biased up by spring 32 so that flapper 34 will close. Circulation shown by arrows 36 can come back to the surface past swell packer 12 as it takes some time before packer 12 swells to the sealing position in FIG. 2. In FIG. 1 there is an open annular space 38 around packer 12. Above packer 22 is upper flapper 40 that is held open by wash pipe 20 until the wash pipe 20 is pulled through packer 22 and to the surface at which time flapper 40 falls shut. In the shut position pressure from the surface can be applied to flapper 40 for well control. Flapper 34 holds back pressure from below trying to come up the hole. While the passage through packer 22 is open on removal of the wash pipe 20, no flow can reach that open passage with flapper 34 in the closed position. Packer 22 in the set position helps to channel circulation flow to the float shoe 42 that has a pair of spring biased check valves 44 and 46. Check valves 44 and 46 prevent flow into the shoe track 16 but the issue with them is that their ability to hold differential pressure from the formation is severely limited to around 5000 PSIG. Larger differentials can develop in deep wells to the order of 15,000 PSIG or more. For that reason the float shoe 42 cannot be relied on as a dual pressure barrier. The dual flappers 34 and 40 provide the high pressure rated barrier assembly that controls pressure up the hole from the formation using valve 34 and allows well control from the surface with flapper 40 by pressure application from surface equipment. As a result of the assembly described above a bottom hole assembly can be more easily run into position in open hole with circulation as the assembly is advanced. The circulation can be run with a float shoe that is not rated for the anticipated pressure differentials because the dual flapper arrangement with the high pressure packer is provided. As previously stated the purpose for the high pressure packer is for direction of fluid when circulating so that the circulating fluid exits the float shoe 42 as opposed to going up the annular gap between the wash pipe 20 and the outer completion or shoe track 16. When the wash pipe or inner string 20 is lifted past flapper 40 flow through the screens that are not shown above isolator 12 can communicate with said inner string for such purposes as gravel packing above isolator 12.

It should be noted that although flapper type valves are preferred that sliding sleeves, balls or plugs could also be used as an alternative with the wash pipe having a shifting profile in it to move the valves to the closed position for well control.

The above description is illustrative of the preferred embodiment and many modifications may be made by those skilled in the art without departing from the invention whose scope is to be determined from the literal and equivalent scope of the claims below:

We claim:

1. A shoe track assembly for facilitating delivery and isolation of a bottom hole assembly comprising:

an outer assembly comprising an external barrier for isolation against a borehole wall, said external barrier defining an adjacent zone of interest and a lower zone on opposed sides thereof;

a shoe track supported by said outer assembly having a float shoe located in said lower zone to facilitate circulation to aid in positioning of said outer assembly, said float shoe having components rated for lower differential pressure than anticipated in said lower zone compared to within said outer assembly;

said outer assembly further comprising an internal passage isolation assembly rated higher than the anticipated pressure differential anticipated between said lower zone and within said outer assembly for pressure control of the borehole.

2. The assembly of claim 1, wherein:

said isolation assembly comprises a packer.

3. The assembly of claim 2, further comprising an inner string extending through said packer.

4. The assembly of claim 3, wherein:

said inner string engaging an actuator for a first valve to open said first valve.

5. The assembly of claim 4, wherein:

said actuator biased to allow said first valve to close when said inner string is retracted.

6. The assembly of claim 4, wherein:

said inner string maintaining a second valve open when engaged to said actuator.

7. The assembly of claim 6, wherein:

said second valve closes when said inner string is moved past said second valve.

8. The assembly of claim 7, wherein:

said first and second valves comprise flapper valves, ball or plug valves or sliding sleeves.

9. The assembly of claim 8, wherein:

said first valve comprises a flapper valve which prevents flow from said lower zone into said outer assembly.

10. The assembly of claim 9, wherein:

said second valve comprises a flapper valve which prevents flow in the opposite direction than said flow prevented by said first flapper.

11. The assembly of claim 8, wherein:

said outer assembly comprises at least one screen located on an opposite side of said packer from said flapper valves and selectively communicating with said inner string when raised past said second flapper valve.

12. A shoe track assembly for facilitating delivery and isolation of a bottom hole assembly comprising:

an outer assembly comprising an external barrier for isolation against a borehole wall, said external barrier defining an adjacent zone of interest and a lower zone on opposed sides thereof;

a shoe track supported by said outer assembly having a float shoe located in said lower zone to facilitate circulation to aid in positioning of said outer assembly, said float shoe having components rated for lower differential pressure than anticipated in said lower zone compared to within said outer assembly;

said outer assembly further comprising an isolation assembly rated higher than the anticipated pressure differential anticipated between said lower zone and within said outer assembly for pressure control of the borehole;

said isolation assembly comprises a packer and an inner string extending through said packer and first and second flapper valves selectively operated by movement of said inner string;

said first and second flapper valves are disposed on opposite sides of said packer.

13. The assembly of claim 12, wherein:

said external barrier comprises a swell packer.

14. A completion method, comprising:

running in a bottom hole assembly having an external isolator to isolate a producing or injection zone from another portion of a borehole;

providing a shoe track comprising a float shoe with float shoe valves rated for less than the anticipated differential from said another portion of the borehole and said producing or injection zone;

providing within said bottom hole assembly a valve assembly rated for more than the anticipated differential from said another portion of the borehole and said producing or injection zone;

circulating through said float shoe valves and said valve assembly when positioning said bottom hole assembly at a predetermined location;

providing pressure control in said bottom hole assembly with said valve assembly with said external isolator set to define said another portion of the borehole.

15. The method of claim 14, comprising:

providing a wash pipe to hold open said valve assembly until said wash pipe is removed.

16. The method of claim 15, comprising:

performing said circulating through said wash pipe;

extending said wash pipe through a packer selectively set against an interior wall of said shoe track; and removing said wash pipe to allow said valve assembly to close.

17. The method of claim 16, comprising:

providing a first and second valves that stop flow in opposing directions in said shoe track as said valve assembly.

18. The method of claim 17, comprising:

pushing a biased actuator for said first valve that further comprises a flapper valve with said wash pipe to open said first flapper;

holding open said second valve that further comprises a flapper valve with said wash pipe;

allowing said bias on said actuator to retract said actuator to let said first flapper valve close when said wash pipe is withdrawn;

allowing said second flapper valve to close when said wash pipe is withdrawn.

19. The method of claim 18, comprising:

providing, as said isolator, a swell packer.

20. The method of claim 19, comprising:

providing at least one screen in said bottom hole assembly in said producing or injection zone.

21. A shoe track assembly for facilitating delivery and isolation of a bottom hole assembly comprising:

an outer assembly comprising an external barrier for isolation against a borehole wall, said external barrier defining an adjacent zone of interest and a lower zone on opposed sides thereof;

a shoe track supported by said outer assembly having a float shoe located in said lower zone to facilitate circulation to aid in positioning of said outer assembly, said float shoe having components rated for lower differential pressure than anticipated in said lower zone compared to within said outer assembly;

said outer assembly further comprising an isolation assembly rated higher than the anticipated pressure differential anticipated between said lower zone and within said outer assembly for pressure control of the borehole.

* * * * *